United States Patent [19]

Bentley

[11] Patent Number: 4,912,878

[45] Date of Patent: Apr. 3, 1990

[54] COMBINED DISPLACING AND CUSHIONING MEANS FOR DETENTION CELL DOORS

[75] Inventor: Leroy Bentley, Covington, Ky.

[73] Assignee: Stewart Decatur Security Systems, Inc., Erlanger, Ky.

[21] Appl. No.: 272,467

[22] Filed: Nov. 17, 1988

[51] Int. Cl.[4] ..... E05F 1/00

[52] U.S. Cl. ..... 49/379; 49/15; 49/411; 49/449

[58] Field of Search ..... 49/379, 449, 411, 15, 49/18

[56] References Cited

U.S. PATENT DOCUMENTS 3,398,482 8/1968 Frederick, Jr. ..... 49/379 X 3,837,117 9/1974 Butt ..... 49/18

4,723,373 2/1988 Jump ..... 49/18

*Primary Examiner*—Philip C. Kannan

*Attorney, Agent, or Firm*—Kinney & Schenk

[57] ABSTRACT

A mounting assembly is provided for a jail cell door. The door is suspended from a trolley and is slidable, on a fixed rail, between fully open and closed positions. Means are provided for releasably locking the door in either of those positions. Stop means at opposite ends of the rail respectively limit movement of the trolley to the closed and fully open positions. Each stop means includes a compression spring which absorbs shock forces when the door is displaced to its extreme positions. The spring means also provide a force for displacing the door from its closed or fully open positions upon release of the means locking the door in either of these positions.

6 Claims, 3 Drawing Sheets

COMBINED DISPLACING AND CUSHIONING MEANS FOR DETENTION CELL DOORS

The present invention relates to improvements in doors for detention cells, and more particularly to improved means for displacing such doors from extreme positions when the door is released from being locked in an extreme position and also for cushioning the door as it is displaced to an extreme position.

More specifically the invention is directed to cell doors which are mounted for sliding movement between fully open and closed positions. These doors are usually suspended from a carriage, or trolley, which comprises rollers that ride on a fixed rail above the cell entryway. While there is rolling contact with the trolley wheels, the doors are referenced as being slidable.

Various means have been devised to lock such cell doors in a closed position and then to release the locking means and permit the doors to be opened.

For various reasons, when the means for locking a door in a closed position is released, it is desirable, if not essential, that the door be displaced to an ajar position. One reason for having an unlocked door ajar is to enable a sensor to give an indication of the unsecured condition of the cell.

Although not done as frequently, means are also conventionally provided to lock cell doors in their fully open positions. Again, when the door is released from being locked in a fully open position, it is desired that the door be displaced from that extreme position.

Another problem in sliding jail cell doors is that they have considerable mass, whether they are of an openwork, barred construction or a solid construction. When these doors are displaced to a either a fully closed, or fully open position, there can be a verys ubstantial shock force on the stops which there can be a very substantial shock force on the stops which limit their movement, as well as on the mounting assembly. These shock forces, unless cushioned, can damage the door mounting and/or require massive components which increase the costs thereof.

It has long been accepted practice to provide one mechanism for cushioning the shock of limiting door movement and a separate mechanism for displacing cell doors from extreme positions upon release of the means which lock them in such positions. While effective, these separate mechanisms involve the expense of components for each mechanism.

The object of the present invention is to minimize the costs of providing the functions of displacing a cell door from an extreme position, upon release of means locking it in such position, and cushioning shock when the doors are displaced to extreme positions.

This end is attained, in a broad sense, in a mounting assembly for a sliding door. The assembly comprises a trolley from which the door is suspended. The trolley is mounted for movement between extreme positions on a fixed, horizontal rail, one extreme position being the fully open position of the door and the other extreme position being the closed position of the door.

Stop means, at opposite ends of the rail, respectively limiting trolley movement to the fully open and closed positions of the door. Each stop means comprises a spring which is compressed during the final portion of trolley movement to an extreme position, thereby absorbing shock in arresting trolley and door movement.

Means are provided for releasably locking the door in its closed position. When released from this closed position, the spring of the stop means, which limit movement to the closed position, provides a force which displaces the door to an ajar position when the door locking means is released.

In its preferred form, each stop means take the form of a fixed tab and pin slidable therein the direction of trolley movement. The pin has a head on its inner end, with the spring, of the stop means, coiled about the pin between the head of the pin and the fixed tab. Means are then provided for maintaining the pins in assembled relation on the fixed tabs.

In this combination, means may also be provided for locking the door in its fully open position. The stop means which limit trolley movement to the fully open door position also provide means for displacing the door from its fully open position when these means are released.

The door locking means may take the form of a drop bar. Notch means can be provided at the bottom of the door. The lower end of the drop bar engages the notch means to lock the door in its closed position. Additional notch means can be provided and engaged by the lower end of the drop bar to lock the door in its fully open position.

Additional door locking means can be provided by a horizontal bar mounted on the trolley and a roller mounted on the drop bar. When the drop bar is in its lower, locking position, this roller is disposed in the path of travel of one end, of the horizontal bar to lock the door in its closed position. It can also be arranged so that the roller is in the path of movement of the other end of the horizontal bar, when the drop bar is in its lower position, to lock the door in its fully open position.

When drop bar is raised to release the door from being locked in its closed position the spring, of the stop means which limit movement to that position, displaces the trolley a distance sufficient to bring the horizontal bar beneath the drop bar roller. Similarly, when the door is locked in its fully open position, the spring of the stop means, which limits movement to that position, displaces the trolley a distance sufficient to bring the horizontal bar beneath the drop bar roller when the drop bar is raised to a release position.

The above and other related objects and features of the invention will be apparent from a reading of the following description of a preferred embodiment, with reference to the accompanying drawings, and the novelty thereof pointed out in the appended claims.

Figure 1:
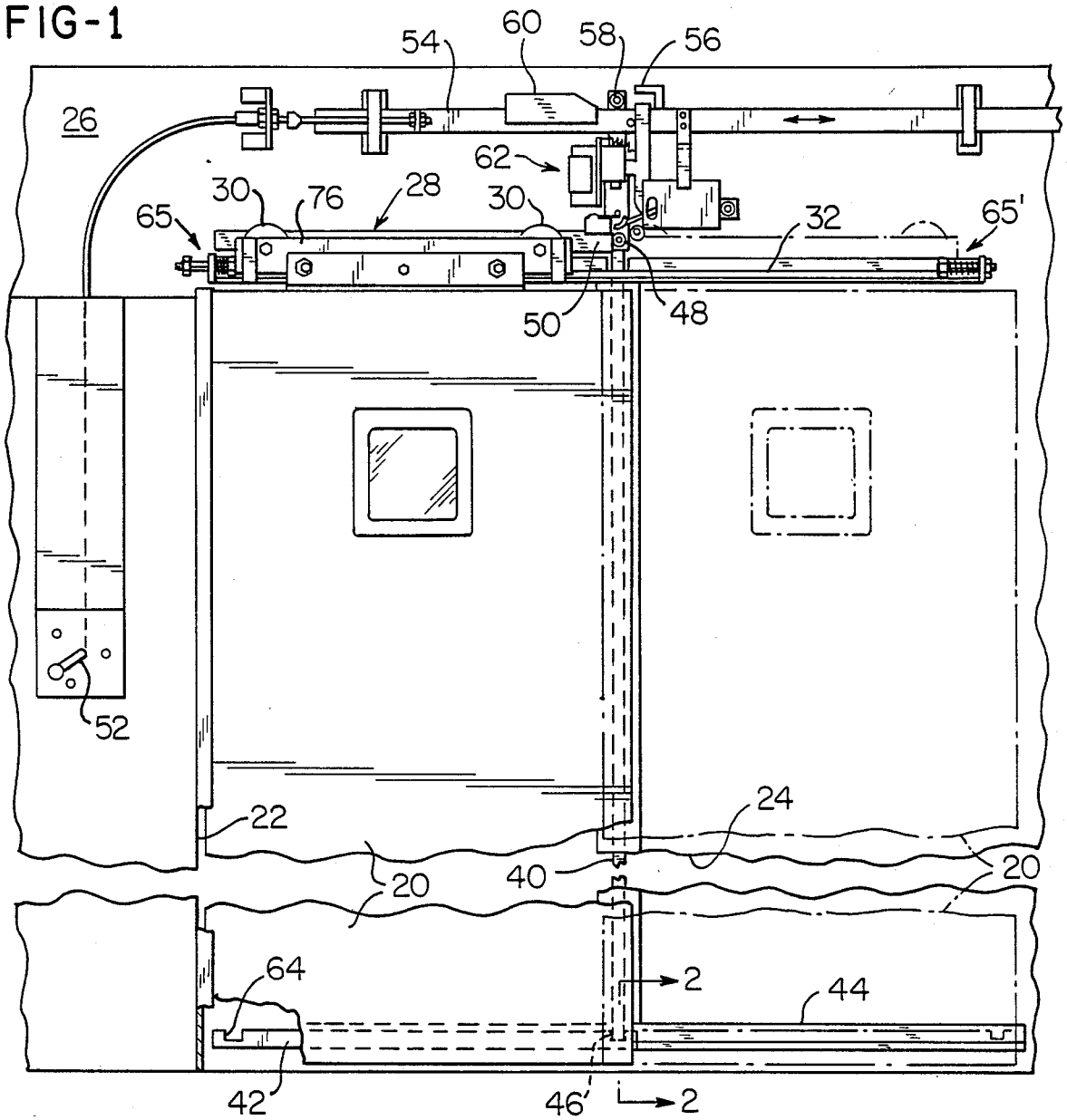
FIG. 1 is an elevation of a detention cell door assembly in which the present invention is embodied.

FIG. 1 illustrates a typical detention cell, which can be the first in a series of cells in a cell block. The cell has a door 20 which controls access to the entryway for the cell. The entryway is defined by walls 22, 24. A transom 26, in the form of a metal plate, extends lengthwise of the cell block, above the entryway. The door 20 is slidable from its closed, full line position to a fully open position illustrated by phantom lines.

The door 20 is suspended from a trolley 28 which comprise a pair of grooved wheels 30. The wheels 30 ride on a rail 32 which projects from the transom 26. While reference is made to the door 20 being slidable, the wheels 30 provide rolling movement for translation between the illustrated positions.

Means are provided for locking the door 20 in its closed position. These means comprise a compositely formed drop bar 40 which is mounted for vertical, sliding movement on the left side of the wall 24 and extends upwardly to the transom 26.

Figure 2:
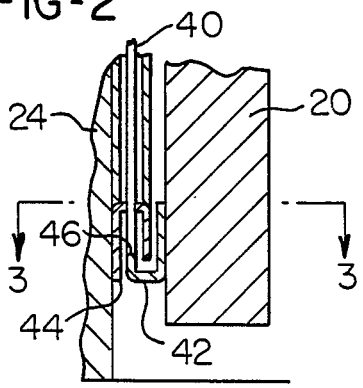
FIG. 2 is a section, on an enlarged scale, taken on line 2—2 in FIG. 1.
Figure 3:
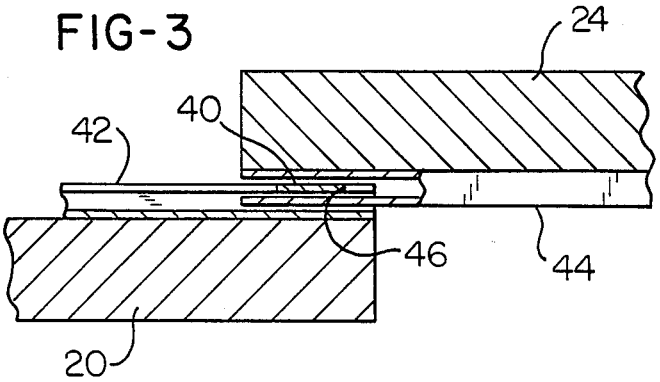
FIG. 3 is a section taken on line 3—3 in FIG. 2.

An upwardly open U channel 42 is secured to the inner surface of the door 20, along its lower end. A downwardly open U channel 44 is mounted on the outer surface of the wall 24. As indicated in FIGS. 2 and 3, these channels interdigitate. The lower end of the door 20 is secured against movement, from its closed position, by the lower end of the drop bar 4 which extends through an opening in the bridge of channel 44 and is received by a notch 46 in the one leg of the channel 42.

A roller 48 is mounted on the drop bar 40 adjacent the trolley 28. Specifically, in the closed position of the door, the roller 48 is disposed in the path of travel of one end of a horizontal bar 50 mounted on the troller 28. The upper end of the door 20 is thus locked against opening movement.

The door 20 is released from its locked, closed position by raising the drop bar 40 to withdraw its lower end from the notch 46 and elevate the roller 48 above the horizontal bar 50.

The means for raising the drop bar 40 and releasing the door 20 from its locked condition may take various forms, pursuant to prior art teachings. The means illustrated in FIG. 1 are more fully shown and described in my copending application Ser. No. 07/272,468, filed contemporaneously with the present application.

Briefly, a control lever 52 may be rotated to laterally shift a master control bar 54. In one position of the bar 54, a hook 56 overlies a roller 58 at the upper end of the drop bar 40 This positively prevents upward, releasing movement of the drop bar. Other hooks on the bar 54 similarly coact with the drop bars of the other cells in the cell block, so that all doors of the block are positively locked in this position of the master control bar 54.

In another position of the bar 54, cams 60 coact with the roller 58 and with the drop bars of the remaining cells in the block, to positively raise the drop bars and release all doors of the cell block for opening movement.

In intermediate positions of the master control bar 54, individual cell control means 62 permit the drop bar of a given cell to be raised by electrical or manual means. Access to individual cells can thus be selectively controlled.

The same mechanism may also be employed to lock the door in a fully open position, as is desired in certain security management programs.

To this end, when the door is displaced to its fully open, phantom position, the lower end of the drop bar, in its lower position, engages a notch 64 in the door channel 42. Also. in this position, the roller 48 is disposed in the path of travel of the other end of the horizontal bar 50, to provide a second means for locking the door.

Figure 6:
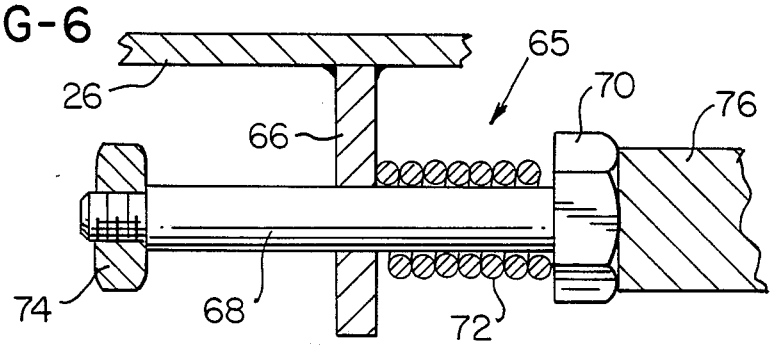
FIG. 6 is a section, on an enlarged scale, taken on line 6—6 in FIG. 4.
Figure 7:
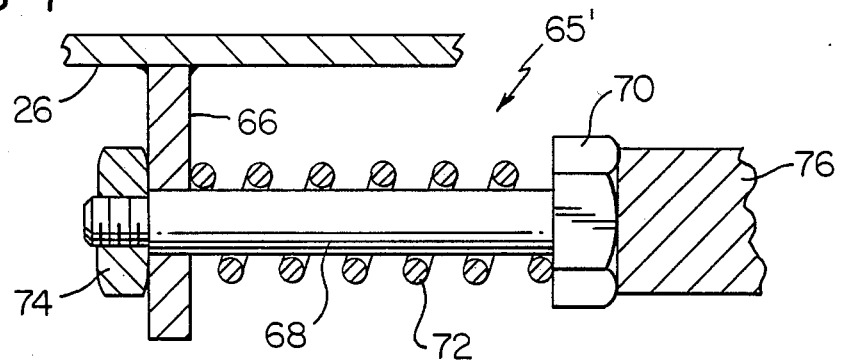
FIG. 7 is a section, on an enlarged scale, taken on lint 7—7 in FIG. 5.

Means 65, 65' are provided at opposite ends of rail 32 for limiting movement of the trolley 28 to the extreme positions of the door being closed or fully open. Each of these means comprise a fixed plate, or tab, 66, FIGS. 6 and 7. A pin 68, in the form of a shoulder screw having a head 70 is disposed in a hole formed in the tab 66. A compression spring 72 is coiled about the pin 68 and disposed between the tab 66 and the inwardly facing screw head 70. A nut 74 is threaded onto the outer end of the shoulder screw to hold the spring in the described, assembled relation.

Figure 4:
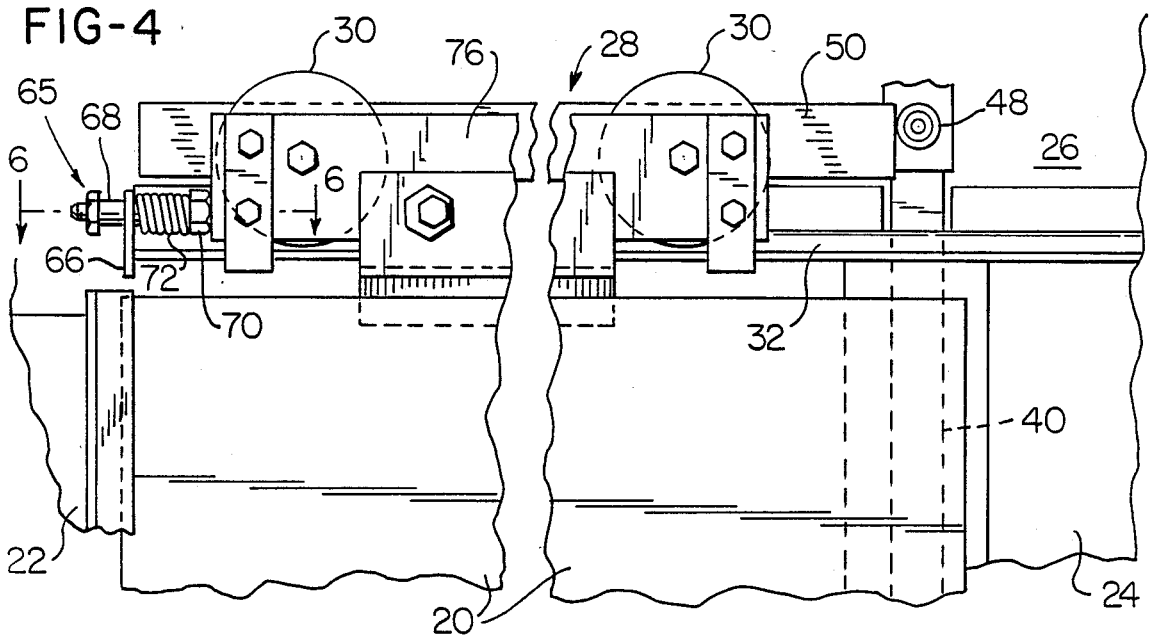
FIG. 4 is an elevation, on an enlarged scale and with portions broken away, of portions of the door assembly seen in FIG. 1, in its closed position.
Figure 5:
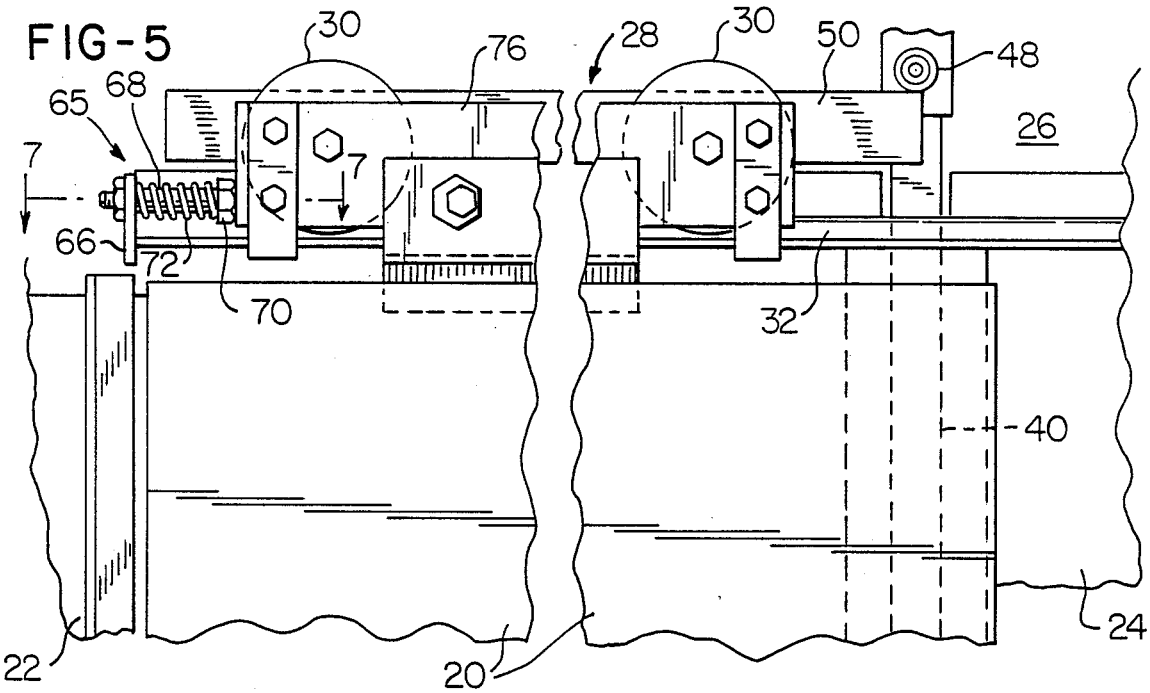
FIG. 5 is an elevation similar to FIG. 4, showing the door in an ajar position.

When the door 20 is displaced to its closed position, the limiting means are operative. A bar 76, forming part of the trolley 28, engages the screw head 70 and compresses the spring 72. The spring 72 thus absorbs shock loadings on the door assembly when, as is a common occurrence, the door is slid with some force to its closed position. The drop bar, when the door is thus closed, may drop to its lower, locking position, as illustrated in FIGS. 1 and 4.

When the drop bar 40 is raised, by the means above referenced, the spring 72 provides a force to displace the trolley to the right and bring the door to an ajar position. The travel of pin 68 is sufficient to dispose the horizontal bar 50 beneath the roller 48 so that the door will not relock until it is purposefully displaced, against the action of spring 72, to its fully closed position. All of this being consistent with established requirements for cell security.

Figure 8:
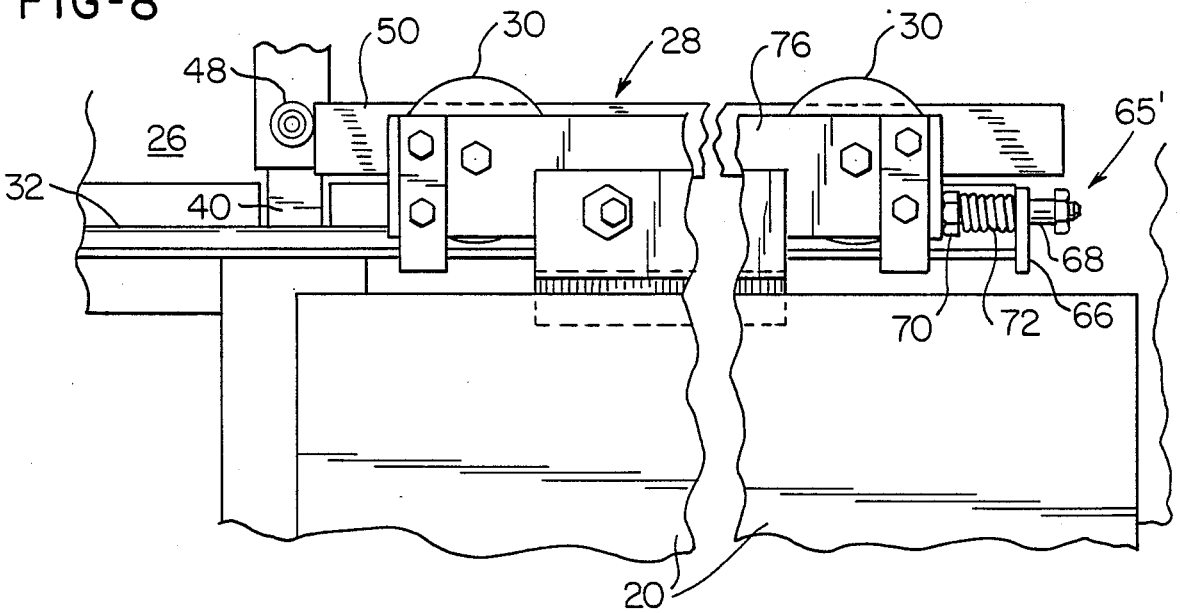
FIG. 8 is an elevation, on an enlarged scale and with portions broken away, of the door assembly seen in FIG. 1, in its fully open position of the door.
Figure 9:
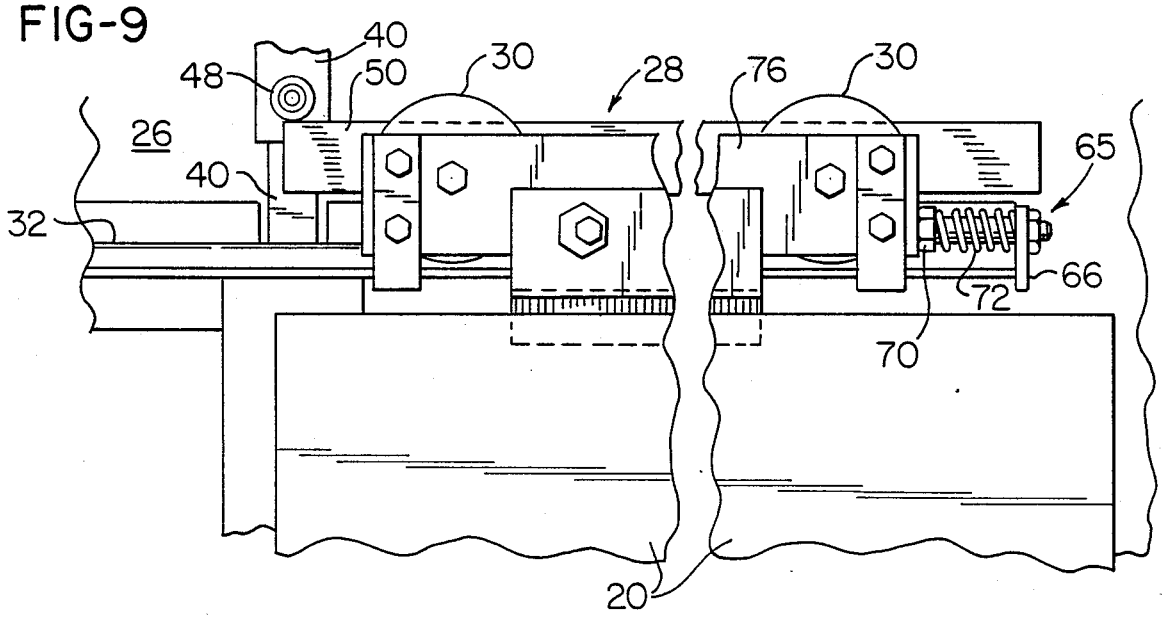
FIG. 9 is an elevation similar to FIG. 8, showing the door displaced from its fully open position.

The limiting means 65' functions is a similar fashion. When the door 20 is displaced to its open position, the spring 72 of that means absorbs shock forces on the door assembly. When the door is in its fully open position, the drop bar may be lowered to its locking position, engaging the notch 64 and bringing the roller 48 into the path of travel of the opposite end of the bar 50, FIG. 8. When the drop bar is raised to the release the door, the spring 72, of means 65' displaces the carriage 28 to the left a distance sufficient to displace the bar 50 beneath the roller 48, as illustrated in FIG. 9.

Variations in the described embodiment will occur to those skilled in the art which will provide equivalent functions within the spirit and scope of the present inventive concepts which are set forth in the following claims.

Having thus described the invention, what is claimed as novel and desired to be secured by Letters Patent of the United States is:

1. In a mounting assembly for a sliding door, said assembly comprising a trolley from which the door is suspended, a fixed, horizontal rail on which the trolley is mounted for displacement between extreme positions, respectively being an open and a closed position of the door, and means for releasably locking the door in its closed position, stop means, at opposite ends of said rail, respectively limiting trolley movement to the open and closed positions of the door, each stop means comprising a spring which is compressed during the final portion of trolley movement to an extreme position thereby absorbing shock in arresting trolley and door movement, and the means limiting movement to the closed position of the door, further providing a force for displacing the door to an ajar position when the door is released from being locked in its closed position.

2. A combination as in claim 1 wherein each stop means comprise a fixed tab projecting into the path of trolley movement, a pin slidable in said tab, in the direction of trolley movement, said spring being coiled about said pin, said pin having a head on its inner, which the spring being disposed between said head and said tab, and means maintaining said pin in assembled relation on said tab.

3. A combination as in claim 1 wherein the door locking means comprise a drop bar, relatively fixed means guiding said drop bar for sliding movement between a raised position and a lower position, and notch means at the bottom of the door which are engaged by the lower end of the drop bar, in the lower position thereof, to lock the door, said trolley including a horizontal bar, said drop bar having a roller disposed in the path of travel of one end of said horizonal bar, when the door is in its closed position and the drop bar is in its lower position, and the spring of the stop means, which limit movement of the trolley to the closed position of the door, displaces the trolley a distance sufficient to dispose the horizontal bar beneath the drop bar roller, when the drop bar is raised to release the door from its locked condition.

4. A combination as in claim 3 wherein a fixed transom is provided above the entryway controlled by the door, the rail is mounted thereon, each stop means comprise a tab disposed at the end of the rail and having a hole therethrough aligned with the direction of trolley movement, a pin slidable in said tab hole, said pin having a head on its inner end, with said spring being disposed between said tab and said head, and a nut threaded on the outer end of said pin to maintain the pin in assembled relation on the tab.

5. A combination as in claim 1 wherein means are provided for releasably locking said door in its fully open position, and the spring of the stop means limiting movement of the trolley to the fully open door position, further provides a force for displacing the door away from its fully open position, upon release of the means locking the door in that position.

6. A combination as in claim 5 wherein the door locking means comprise a drop bar, relatively fixed means guiding said drop bar for sliding movement between a raised position and a lower position, and notch means at the bottom of the door which are selectively engaged by the lower end of the drop bar, in the lower position thereof, to lock the door in it closed or fully open position, said trolley includes a horizontal bar, said drop bar has a roller disposed in the path of travel of one end of said horizonal bar, when the door is in its closed position and the drop bar is in its lower position, said roller being disposed in the path of travel of the other end of the horizontal bar when the door is in its fully open position and the drop bar is in its lower position, the spring of the stop means, which limit movement of the trolley to the closed position of the door, displaces the trolley a distance sufficient to dispose the horizontal bar beneath the drop bar roller, when the drop bar is raised to release the door from its locked condition in the door closed position, and the spring of the stop means, which limit movement of the trolley to the open position of the door, displaces the trolley a distance sufficient to dispose the horizontal bar beneath the drop bar roller, when the drop bar is raised to release the door from its locked condition in the door open position.

* * * * *